United States Patent [19]

Downing

[11] 4,064,636

[45] Dec. 27, 1977

[54] APPARATUS FOR DELINTING COTTONSEED

[75] Inventor: James D. Downing, Scott, Miss.

[73] Assignee: Delta and Pine Land Company of Mississippi, Scott, Miss.

[21] Appl. No.: 646,267

[22] Filed: Jan. 2, 1976

[51] Int. Cl.[2] ..... F26B 19/00; D01B 1/04

[52] U.S. Cl. ..... 34/60; 19/40; 19/44; 34/61; 47/58; 47/DIG. 9; 134/28; 134/30

[58] Field of Search ..... 134/27, 28, 30, 37; 19/40, 44, 45, 46, 47; 47/58, DIG. 9; 162/95; 34/60, 61

[56] References Cited

U.S. PATENT DOCUMENTS

| | | | |
|---|---|---|---|
| 249,691 | 11/1881 | Taylor | 19/40 X |
| 299,378 | 5/1884 | Green | 19/40 X |
| 307,190 | 10/1884 | Green | 134/28 X |
| 466,669 | 1/1892 | Faulkner | 19/47 |

FOREIGN PATENT DOCUMENTS

| | | | |
|---|---|---|---|
| 30,859 | 2/1889 | Canada | 19/40 |
| 285,305 | 2/1928 | United Kingdom | 19/45 |
| 4,896 | 12/1876 | United Kingdom | 19/40 |

*Primary Examiner*—S. Leon Bashore
*Assistant Examiner*—Marc L. Caroff
*Attorney, Agent, or Firm*—Strauch, Nolan, Neale, Nies & Kurz

[57] ABSTRACT

Cotton seed is delinted in a continuous system wherein dilute acid is sprayed onto a moving agitated horizontal column of seed while controlling the weight ratio of dilute acid to seed and then the wet seed is partially dried by being conveyed by a hot air stream to a cyclone as a flash drying operation and then formed into a horizontal moving column which is agitated by the combined action of (a) a combination conveyor-agitator and (b) the transverse passage of hot drying air to complete drying and then subjected to a scrubbing operation wherein the degraded fibers are removed and the fibers, other very light particles and odors are removed from the seed mass by an exhaust system.

9 Claims, 2 Drawing Figures

APPARATUS FOR DELINTING COTTONSEED

This invention relates to the treatment of cottonseed to remove residual fibers or linters, and is particularly concerned with a novel method and apparatus for acid delinting of the seed.

Cottonseed emerging from the usual ginning process has a covering or fuzz of relatively short residual fibers called linters attached to the hull. This untreated seed in bulk has a tendency to collect in random ball-like groups, a condition that interferes with subsequent handling, processing, grading and use of the seed, such as in oil and meal making machines and the processing, grading, chemical treatment and use of the seed for planting.

As a result methods and apparatus have been proposed for delinting or removing these short fibers, which may be generally classified as mechanical delinting and acid delinting.

Where the seed is to be further treated, as by coating with disinfectant, fungicide or the like to increase its disease resistance after planting special machines have been developed that recognized the foregoing conditions and attempt to solve both the seed handling and coating problems without delinting in the same machine, as disclosed in U.S. Letters Patents to Gustafson No. 2,823,904 and Cordell et al No. 3,155,542.

Mechanical delinting is usually accomplished by apparatus employing high speed sharp saws or abrasive surfaces that cut or rub the fibers off the hull, and it has some advantage of cost recovery in that the removed fibers are not degraded and have some fiber length and may be used as cushion material or for any process such as paper making requiring a cellulosic starting material. Mills that process the seed for oil and meal often prefer this system, since attendant cutting and damage to the hull are usually not objectionable in the further use of the seed which is later crushed anyhow.

Mechanical delinters are however initially expensive and of rather low capacity, and they require frequent down time for regular maintenance, since for example the saws or the like become dull and must be resharpened or replaced periodically. Their power requirements are high, which increases operating costs. Moreover for some purposes, as where the seed is to be used for planting, mechanical delinting that might damage the seed is normally undesirable.

An example of a saw-type delinter is disclosed in U.S. Letters Patent No. 672,297 to Swenson et al.

Acid delinting is also used conventionally, especially where the seed is to be used for planting.

In a known acid delinting process using hydrochloric acid, a weighed batch of cottonseed after ginning is pre-dried to some extent and deposited in a rotatable tube which serves as a sealed reactor chamber. Hydrochloric acid gas is injected into the reactor chamber, and the gas attacks and degrades the cellulose fibers and causes them to become brittle and break away easily. The amount of hydrochloric acid gas introduced is usually selected in a desired weight ratio relative to the batch weight of the untreated seed. Heat is used to speed up the chemical reaction. At the end of the processing time, the hydrochloric gas vapor that is left is removed, as by a vacuum exhaust, the chamber is opened, and the seed removed and put into perforated rotating cylinders which abrades the seed sufficiently to cause the degraded fibers to detach from the hulls and fall through the perforations in the cylinders. The seed are then passed through a neutralizing chamber where anhydruous ammonia is vaporized through the seed to neutralize any residual acid on the seed hull. The seed is now ready for cleaning, grading, and bagging.

This method is currently used only in areas where ambient humidity levels are very low. Control of the hydrochloric acid gas as well as the ammonia vapor is very difficult. Control of the moisture level in the cottonseed before processing is very difficult. The process itself is dangerous in that the seed can be killed from excess heat in either the reactor or the dryer and from excesses of hydrochloric acid gas and necessary anhydrous ammonia. Locations of these plants are characterized by an objectionable smell and white foggy clouds of ammonia vapor around the plant on days of high humidity, and by severe corrosion of adjacent building structure and building materials.

In other known types of acid process using concentrated sulfuric acid, seed is metered into a continuous flow reactor which mixes 93–98% pure liquid sulfuric acid in a bath with the cottonseed. Some plants add small amounts of water, also, to speed the chemical reaction. The acid reacts with the fibers and degrades and converts them into a sludge removed from the hulls, and may also, if not controlled, damage seed for planting purposes due to heat from the chemical reaction or may dissolve some of the exterior layers of the hull coat which, if deteriorated too deeply, make the seed unacceptable for planting seed. On passing out of the acid application section the seed passes through a wash section where high intensity water jets wash the acid and sludge from off the seed and through perforations in the bottom of the reactor chamber. The seed then passes through a dryer where remaining surface moisture is removed, and, in some cases, then through an anhydrous ammonia neutralizer where acid left on the seed coat is neutralized. In most instances however, seed are not so neutralized, and large amounts of water are used to remove the acid. The seed is then ready for final cleaning, grading and bagging.

The liquid washings containing acid and lint sludge produce a tremendous effluent disposal problem. Environmental laws are now requiring processing plants that use this method to improve disposal and the processors are having difficulty solving the problem. Moreover, the consumption of sulfuric acid in this delinting method is approximately ½ ton of sulfuric acid per ton of seed, so that high operating cost in acid usage as well as the effluent disposal are problems.

Various acid delinting systems are disclosed in U.S. Letters Patent No. 310,628 to Wahl; Stead No. 340,635 and Dudley et al No. 344,651. After removal of the linters, where the seed is to be used for planting, it may pass through cleaning and grading machines and through machines of the type disclosed in said Gustafson and Cordell et al patents for coating with disinfectant, disease resistant materials and the like, although these machines may now be simplified in view of the improved condition of the seed.

The present invention has as its major object novel methods and apparatus in an acid delinting system.

In this connection it is an important object of the invention to provide a novel acid delinting method and apparatus wherein dry undelinted cottonseed being fed at a controlled rate and while being agitated is sprayed by dilute acid, preferably sulfuric, control of the amount of acid being sprayed being correlated to the rate of feed of the seed so that only enough acid is supplied as may be necessary to thoroughly wet and degrade the linters.

Another object of the invention lies in the provision of a novel acid delinting process and apparatus wherein cotton seed after being sprayed with dilute acid in sufficient amount to dissolve linters is subjected to special high velocity drying operations.

A further object of the invention is to provide a novel method and apparatus for acid delinting of cottonseed wherein dry uncleaned seed is sprayed with dilute acid in a controlled weight-ratio system, and then rapidly air dried.

Another object of the invention is to provide a novel acid delinting method and apparatus wherein a moving substantially horizontal column of cottonseed is agitated while being sprayed with substantially only enough dilute acid to wet the surface fibers on the seed hulls and then subjected to special rapid drying under relatively high temperature conditions.

A further object of the invention is to provide a novel cotton delinting apparatus wherein a moving substantially horizontal column of the uncleaned seed is wetted by spraying dilute acid on it while it is being agitated, and then picked up by a pressurized stream of hot air and passed through controlled staged drying operations.

Further novel features and other objects of this invention will become apparent from the following detailed description, discussion and the appended claims taken in conjunction with the accompanying drawings.

BRIEF DESCRIPTION OF DRAWINGS

FIG. 2 is a section substantially on line 2—2 of FIG. 1 showing a preferred form of conveyor-agitator.

PREFERRED EMBODIMENTS

Figure 1:
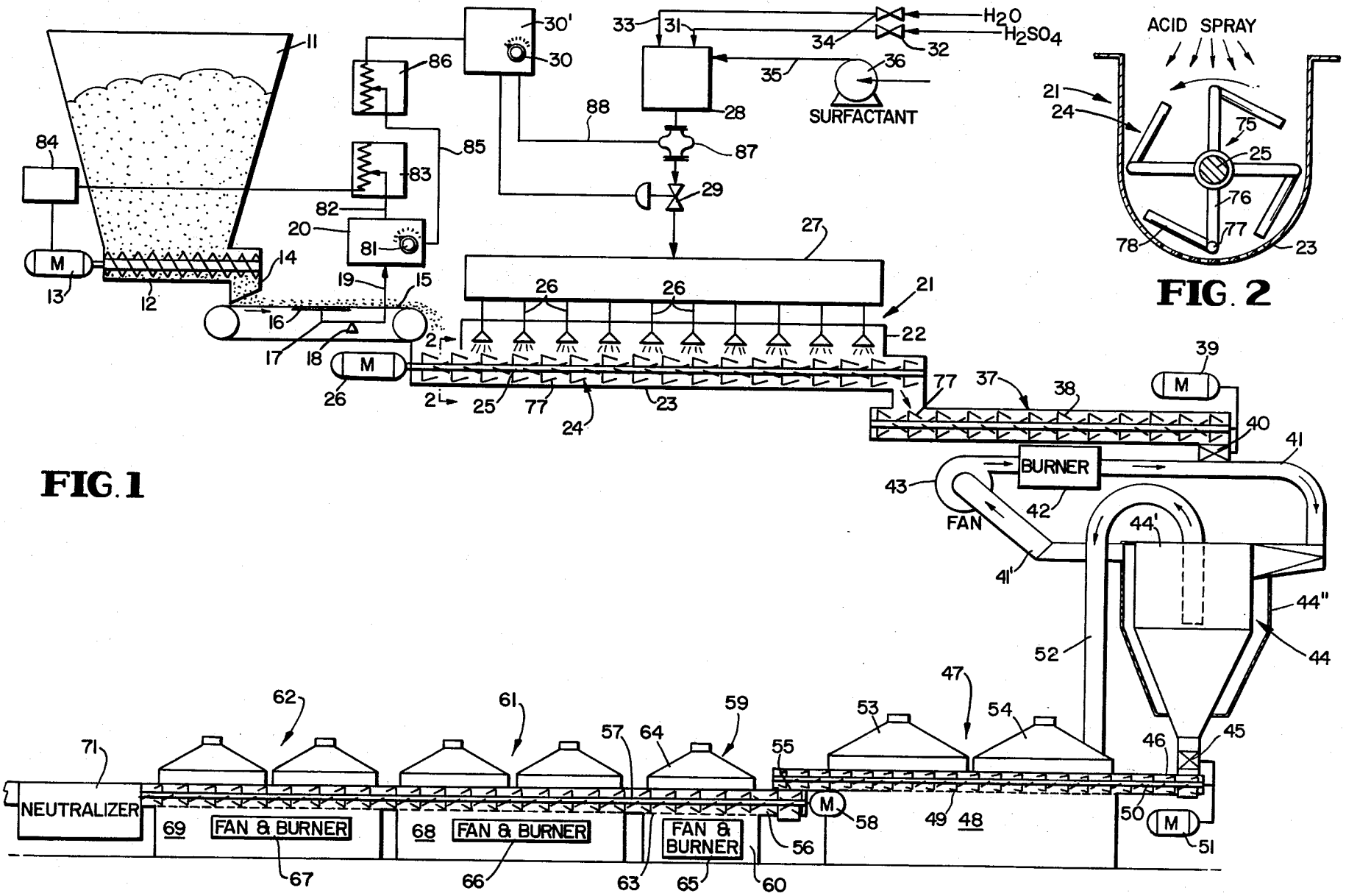
FIG. 1 is a generally diagrammatic view showing the method steps and apparatus according to a preferred embodiment of the invention.

Referring to FIG. 1 the method and apparatus are at least diagrammatically illustrated in all stages of the seed handling.

Supplies of the seed to be cleaned of its surface fibers are deposited in a hopper or bin 11. The seed may or may not have been pre-dried and/or pre-dried to a desired moisture content. Bin 11 is preferably of the live bottom type wherein one or more feed screws 12 at the bottom are driven as by an electric motor 13 to assure a controlled metered delivery of the seed into the apparatus. Bin 11 may be of any suitable type, and for example may be like that disclosed in Burke U.S. Pat. No. 3,142,419.

The speed of motor 13 determines the rate of feed of seed to the apparatus, and thus uncleaned seed is constantly discharged from the bin at a controlled rate through outlet 14 onto the top flight of an endless conveyor belt 15 that is driven at a constant speed (by a motor not shown). There is thus deposited on belt 15 a continuously moving uniform cross section horizontal column of seed to be further handled and processed.

As shown, a portion of the belt bearing the seed is passed over a weigh scale platform 16 that is connected to a balance lever 17 pivoted on a fulcrum 18 and connected by arm 19 to a control unit 20 for a purpose to appear.

The foregoing weigh system thus continuously measures the weight of a predetermined volume of the seed, and so continuously measures the weight rate of flow of the seed into the apparatus.

The seed from belt 15 drops into a seed wetting section 21 comprising a housing 22 having a lower horizontal trough 23 in which is disposed a conveyor-agitator 24 that agitates the seed while feeding it to the right in FIG. 1. The shaft 25 of conveyor-agitator 24 is driven by an electric motor 26. As will appear conveyor-agitator 24 is of special structure for optimum agitation of the seed while feeding the moving column of seed.

During passage of the seed through section 21, it is sprayed with a dilute acid over a predetermined length of the horizontal column. In a preferred embodiment a series of horizontally spaced low pressure spray nozzles 26 are provided in housing 22 above the level of the moving agitated seed mass, so that a predetermined length of the column of agitated seed moving through section 21 is thoroughly sprayed during passage. As will appear the amount of dilute acid sprayed onto the seed is so regulated that all of the dilute acid is absorbed in the fibers or is on the surfaces of the fibers and there is no accumulation of liquid dilute acid in trough 23.

During passage through section 21, the seed is uniformly wetted, this being assured by the continuous agitation and the maintained spray period.

Nozzles 26 are connected to a common manifold 27 that in turn is connected to a supply tank 28 of the dilute acid through an adjustable control valve 29. The setting of valve 29 determines the rate of feed of dilute acid onto the seed. The opening of valve 29 is selected by an adjustment at 30 of a control unit 30'.

As shown the level of dilute acid in tank 28 may be selected and maintained through a feed line 31 having a valve 32, and the concentration of the acid in tank 28 may be controlled by admitting water through a feed line 33 having a control valve 34. A surfactant to improve the efficiency of wetting of the fibers may be introduced into the tank 28 through a line 35 having a metering pump 36.

At the outlet of the seed wetting section 21 the wet seed is passed through a mixer section 37 containing a conveyor-agitator 38 driven by a motor 39. Conveyor-agitator 38 may be of the same type of conveyor-agitator used at 24 during the stage of wetting the seed with acid. In the mixer section however it is preferable to drive the conveyor-agitator at a speed somewhat less than during wetting, and desirably with increased agitation, whereby during passage through the mixer section more time and opportunity is allowed for the dilute acid to become completely absorbed into and along the fibers on the seed hulls. A moving column of seed having the surface fibers thereof uniformly and completely wetted with absorbed dilute acid is therefore continuously discharged through a rotary air lock 40 driven by motor 39 into the dryer phase of the apparatus.

At this point it will be noted that the optimum condition contemplated in the invention is that the seed entering the dryer phase is thoroughly wetted by the dilute acid absorbed into or on its fibers to be removed and that substantially no liquid acid is present.

The wet seed leaving mixer section 37 is picked up by a stream of pressurized heated air passing through a conveyor tube 41, the air being controllably heated by a burner 42 and pressurized by a fan 43. The rotary air lock 40 is of a conventional construction, and it permits passage of seed into tube 41 while preventing loss of air pressure. The conveying air in tube 41 is heated to a flash drying temperature that is considerably higher than is usually employed in conventional seed drying systems, namely up to about 600° F.

The stream of hot air containing the wet seed is directed into the upper cylindrical section 44' of a conventional type cyclone separator 44 wherein the wet mass is whirled in an annular path with both the hot air stream and the cyclone serving as a flash dryer so that seed are rapidly partially dried to a controlled degree. The air temperature entering the cyclone may now be somewhat less than the air temperature in tube 41 but still quite high. In the cyclone the drying seed eventually drops down through a rotary air lock 45 into a horizontal trough 46 that enters and passes through a dryer section 47. The cyclone may be enclosed by an insulating shroud as shown at 44" to form a plenum around the cyclone. The fan 43 may be connected by an intake duct 41' to the plenum so that preheated air is drawn into the system whereby heat losses are considerably reduced.

Dryer section 47 contains a relatively long compartment 48, and the portion of trough 46 within compartment 48 has a bottom wall formed with a multiplicity of perforations 49. A conveyor-agitator 50 of a type similar to that at 24 extends the length of trough 46, and both rotary lock 45 and the conveyor-agitator are driven by motor 51. All of the hot drying air under pressure is conveyed from the cyclone through conduit 52 into dryer compartment 48 where it passes up at high velocity through perforations 49 and through the horizontally moving column of wet seed which is being agitated by the air passing therethrough as well as by the screw while being moved from right to left along trough 46. Compartment 48 is continuously exhausted as by hoods 53 and 54.

By the time the drying air reaches compartment 48 it may have dropped in temperature to about half the air temperature entering the flash dryer system but this is usually sufficient to accomplish complete drying of the fibers without requiring auxiliary heating. Also by this time the air pressure has dropped considerably but the drying action is thorough in that relatively large volumes of hot air move rapidly through the agitated seed mass. The air temperature at exhaust under the foregoing conditions is considerably lower than the temperature of the drying air reaching compartment 48. If desired or necessary auxiliary heat may be introduced at 48.

As shown the opposite ends of trough 46 which are outside compartment 48 are closed pressure tight except for the intake below air lock 45 and the outlet indicated at 55 where the seed drops into a further horizontal trough 56.

Trough 56 contains a long conveyor-agitator 57 which also may be of the same type as at 24 driven by a motor 58. This trough and conveyor-agitator assembly extend through a first scrubber section 59 having a compartment 60, and second and third scrubber sections indicated at 61 and 62. Trough 56 is air tight except for its inlet and outlet connections and perforations in the compartments as will appear.

In scrubber section 59, preheated air, just hot enough to make scrubbing efficient, is delivered under pressure into compartment 60 and passes up through perforations 63 in the bottom of the trough to traverse the horizontally moving seed column which is being agitated by the screw and air flow while being conveyed. Compartment 60 is exhausted at hood 64. A conventional type controlled temperature fan and burner assembly 65 supplies the heat to compartment 60.

The seed column entering the first scrubber section 59 is by this time fairly dry. As the seed drys, water being evaporated therefrom, the acid in the fibers becomes progressively concentrated and fiber degradation which starts noticeably when the acid therein becomes increasingly concentrated accelerates. In scrubber section 59 the mechanical action of the conveyor-agitator starts effective separation of the degraded fibers from the seed hulls, and these separated fibers are removed in the exhaust along with water vapor, very light particles, odors, and fumes.

Scrubber sections 61 and 62 have sources of heated air 66 and 67 independently supplying heated air under pressure to compartments 68 and 69 respectively where the air passes through the moving horizontal column of seed and picks up residual odors, very light trash particles and the remaining separated fibers. As shown exhaust hoods are connected to the compartments. All of the foregoing exhaust hoods may be connected into a common manifold or system for disposal of the fumes, trash and fibers.

The velocity of the air passing through the seed is preferably greater in the scrubbing sections than in the dryer section 47, and air velocities through the seed in compartments 68 and 69 are preferably greater than in the first scrubber compartment 60. The air temperatures in the scrubber sections are lower than in the dryer sections and air temperatures in compartments 68 and 69 may be lower in compartment 60.

In a practical embodiment, the trough 56 is continuous through the scrubber sections, and the sections of conveyor-agitator 57 are on a common shaft suitably driven at a selected speed by motor 58.

Upon emerging from the dryer and scrubber unit, the dry seed now cleaned of its fibers is passed into a neutralizer unit wherein it is subjected to the action of a base such as ammonia gas to neutralize any remaining acid. This may be a conventional arrangement such as has been used in prior systems. Another base may be used to neutralize the acid provided that it does not make the seed unsuitable for its intended purpose.

The seed emerging from neutralizer 71 is now cleaned of its surface fibers and is free of acid, so that it is now ready for the ultimate use such as planting, or oil or meal production.

In the invention the horizontal feed speed of the seed is preferably greater in the dryer section 47 than in the scrubber sections 59, 61 and 62 to obtain better drying and reduce possible seed damage. Another advantage of this is that the fibers do not detach in quantity until they enter the scrubber section and the slower speed affords more time to pick up and exhaust the fibers.

The conveyor-agitator in all of the troughs are preferably of the same general shape and disposition in the trough which is illustrated in FIG. 2, the agitating and conveying elements 75 being rods welded at one end to the shaft and each comprising a generally radial section 76, a section 77 (FIG. 1) extending generally longitudinally of the shaft but at an angle that determines seed feed agitation and an angularly related terminal section 78. Note for example in FIG. 1 that element section 77 in the mixer 37 is indicated as disposed at a larger acute angle to the horizontal than in the wetting section for greater agitation of the moving seed column.

In the preferred mode of practice of the invention, sulfuric acid is mixed in tank 28 to a desired concentration, concentrated (93–98%) acid from line 31 being diluted as required by the admission of water from line 33. The acid is preferably diluted in the range of 5–20% concentration. The surfactant may be any suitable nonionic or catonic wetting agent such as a detergent added in sufficient quantity to increase the wetting action of the dilute acid in the seed wetting section 21.

The dilute acid may be mixed in batches in tank 28, or after an original mixture is made in tank 28, the relative flows in the lines 31, 33 and 35 may be set to maintain the tank level by supplying acid, water and surfactant at the rate it is dispensed through valve 29.

In operation the control motor 13 is started for feeding uncleaned seed, with the adjustable control element 81 of control unit 20 set to establish a desired speed for motor 13 that will result in flow of seed through bin outlet 14 at a desired weight rate. The weight rate of feed of the seed from the bin will stabilize under control of a signal transmitted by the weighing system 16–19. In this respect control 20 may be of the type that in response to movement of arm 19 sends along line 82 a low pressure signal to a responsive variable resistance device or the like 83 in circuit with a regulator 84 for motor 13, with the result that when the weighing system at 16–19 indicates that the desired feed weight rate has been achieved the speed of motor 13 will become constant. This steady condition of motor 13 will be maintained unless or until a change occurs in the weight rate and is detected by the weighing system which then actuates the control unit to speed up or slow motor 13 to restore the weight rate of feed at the preset level.

The desired volume ratio of dilute acid per unit of seed weight passing through valve 29 is preset by the control at 30, and this is normally maintained throughout operation.

If desired an ancillary control of the rate of acid feed may be provided by connecting an output signal from control unit 20 through line 85 to a variable resistance or the like 86 in circuit with the valve control unit 30', so that the rate of feed of acid from the tank may be automatically varied in accord with changes in the weight rate of feed of the seed. In accomplishing the foregoing, a flow monitor 87 may be installed in the dilute acid line leading to valve 29, and this flow monitor sends a signal on line 88 to control unit 30' that is proportional to the flow rate of the dilute acid. The signal on line 88 is suitably correlated in unit 30' with the signal from control unit 20 to correspondingly automatically vary the preset opening of valve 29. Unit 30' thus is enabled to control the volume flow rate of dilute acid per unit weight feed rate of seed to a preset value. In summary, the weight of seed being treated per unit period is initially preset and determined by the speed of motor 13, and the weight of dilute acid per unit period is preset and determined by the setting of valve 29. These are normally established at the beginning of an operation to provide a weight ratio of seed to dilute acid such that there is sufficient wetting of the agitated seed to thoroughly saturate the fibers on the seed hulls but there is no collection of excess liquid acid in trough 23. The weighing system at 16–19 acts through control unit 20 to maintain that ratio as constant as possible.

The dilute acid sprayed on the seed is preferably present in the range of 10–30% of the weight of seed.

During the initial drying phase, the thoroughly wetted seed is subjected to a substantially flash drying operation in the hot air conveying system and the cyclone, before passing to the finishing dryer.

In the finishing dryer at 47 the drying air is forced through the moving agitating seed column at relatively high velocity and at a high temperature in order to complete desired drying as rapidly as possible. In a practical embodiment the drying time may be as low as about 3 minutes, as compared to about 17 minutes drying time in a system wherein the seed is initially deposited into a bath of acid. However it is preferable that the seed feed speeds are so correlated with the temperature that seed exciting from the dryer section 47 are not damaged in any way which would render the seed unusable for planting.

As a result of the foregoing the seed conveyed from the dryer section to the scrubber section may still have some wet surface fibers. This seed in passing through the scrubber is subjected to substantially the same mechanical treatment as in the dryer but the temperatures are lower in the scrubber. Completion of the drying in the scrubber completes degradation and removal of all fibers from the seed hulls.

The invention therefore provides a system wherein only enough acid is introduced as will be needed to wet the fibers on the seed hulls, and the wetted seed is subjected to extremely rapid hot air drying and scrubbing operations, so that far greater amounts of seed may be cleaned at a smaller cost than previously.

Operational costs in terms of required acid per pound of seed cleaned are greatly reduced in particular. The apparatus advantageously represents a considerably lower capital expense per unit of seed processed than known systems.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for the acid delinting of cottonseed having surface fibers of cotton comprising means for establishing and conveying along a path an agitated body of said cottonseed to be delinted, means for spraying acid onto said seed while it passes along a predetermined portion of the path to wet said fibers, control means for combining acid and seed at such respective rates of supply that substantially only enough acid is sprayed onto the seed as can be absorbed into said fibers and said acid being capable of degrading said cotton fibers, and means for drying said wet seed comprising means for subjecting wet seed agitation while passing hot air therethrough, including a conduit through which the wet seed is initially moved by pressurized hot air, a cyclone separator into which said conduit discharges the now partially dried seed, bottom perforated trough means receiving seed from said cyclone separator, conveyor agitator means for moving the seed along said trough means, and means for passing hot air through the agitated seed all along said trough means for completing drying of the fibers and removal of degraded fibers from the seed.

2. The apparatus defined in claim 1, wherein means is provided to establish said body as a longitudinally moving column of seed fed from a supply receptacle, and said control means comprises means for controlling the weight rate of feed of said seed in establishing said column.

3. The apparatus defined in claim 2, wherein said receptacle is a hopper having a motor driven screw feed discharge, and said control means comprises a weigh system responsive to the weight of said moving column connected to control means for said motor.

4. Apparatus as defined in claim 1, wherein said column of seed is conveyed along an open top substantially horizontal guide by a conveyor-agitator that transversely agitates the seed, and said spray means is disposed over a predetermined length of said guide.

5. Apparatus as defined in claim 1, wherein a supply container of dilute acid is connected through a valve to said spray means, and means is provided to adjust said valve to correlate in predetermined ratio the rate of supply of said acid to the amount of moving seed being sprayed thereby.

6. Apparatus as defined in claim 1, wherein said seed is fed from a supply receptacle onto a continuously moving conveyor, and said control means comprising a weigh system responsive to the weight of seed on the conveyor and connected to means for controlling the rate of feed of said seed from the receptacle.

7. Apparatus as defined in claim 1, wherein said means for conveying the wet seed to the dryer means comprises means providing a pressurized stream of hot air into which said wet seed is discharged.

8. Apparatus as defined in claim 7, wherein said dryer means comprises a flash drying section into which the wet seed is initially introduced.

9. Apparatus for the acid delinting of cottonseed having surface fibers of cotton comprising means for establishing and conveying in a predetermined direction a body of cottonseed to be delinted, means for agitating the moving seed, means for spraying acid onto the moving seed to wet the fibers, conveyor means disposed for receiving the wetted seed and feeding it to a first dryer section comprising a conduit into which the wet seed is discharged and means for forcing a stream of heated high temperature air along said conduit to subject the moving seed to a flash drying operation, a further flash dryer section comprising a cyclone separator connected to receive seed from said conduit and apply heated air to said seed, means for then feeding the seed to another dryer section containing conveyor-agitator means constructed and arranged to feed and agitate the seed and means for passing heated air through the seed being agitated in said conveyor-agitator means comprising means for conveying heated air from said further flash dryer section to pass through the seed being agitated in said conveyor-agitator means, and means for removal of degraded fibers from the seed connected to receive seed from said conveyor-agitator means.

* * * * *

UNITED STATES PATENT OFFICE

CERTIFICATE OF CORRECTION

Patent No. 4,064,636 Dated December 27, 1977

Inventor(s) James D. Downing

It is certified that error appears in the above-identified patent and that said Letters Patent are hereby corrected as shown below:

Column 8, Claim 1, line 54, after "seed" insert --to--.

Column 9, Claim 6, line 23, change "comprising" to --comprises".

Signed and Sealed this

Sixteenth Day of May 1978

[SEAL]

Attest:

RUTH C. MASON
Attesting Officer

LUTRELLE F. PARKER
Acting Commissioner of Patents and Trademarks